US006640156B1

(12) United States Patent
Brooks et al.

(10) Patent No.: US 6,640,156 B1
(45) Date of Patent: Oct. 28, 2003

(54) SHEET HANDLING SYSTEM

(75) Inventors: Stephen Derek Brooks, Hants (GB); Brian Robinson Kirk, Glos (GB); Dean James Gifford, Glos (GB); Bernhard Leisch, Wels (AT)

(73) Assignee: De La Rue International Limited, Basingstoke Hampshire (GB)

( * ) Notice: Subject to any disclaimer, the term of this patent is extended or adjusted under 35 U.S.C. 154(b) by 0 days.

(21) Appl. No.: 09/914,051

(22) PCT Filed: Mar. 16, 2000

(86) PCT No.: PCT/GB00/00988

§ 371 (c)(1),
(2), (4) Date: Nov. 26, 2001

(87) PCT Pub. No.: WO00/57367

PCT Pub. Date: Sep. 28, 2000

(30) Foreign Application Priority Data

Mar. 22, 1999 (GB) ..... 9906582

(51) Int. Cl.[7] ..... G07D 9/00
(52) U.S. Cl. ..... 700/213; 700/223; 209/534
(58) Field of Search ..... 700/213, 223; 209/534; 271/298, 4.04

(56) References Cited

U.S. PATENT DOCUMENTS 4,236,639 A * 12/1980 Boettge et al. ..... 209/534
4,722,443 A * 2/1988 Maruyama et al. ..... 209/534
4,787,518 A * 11/1988 Yuge et al. ..... 209/534
5,167,300 A 12/1992 Yoshida et al.
5,452,419 A * 9/1995 Di Giulio et al. ..... 709/200
5,798,929 A * 8/1998 Stenzel et al. ..... 700/213
6,074,081 A * 6/2000 Smith et al. ..... 700/223
6,305,550 B1 * 10/2001 Berz ..... 209/534

FOREIGN PATENT DOCUMENTS

DE 27 60 453 C2 1/1979
GB 2 128 594 A 5/1984

* cited by examiner

*Primary Examiner*—Patrick Mackey
(74) *Attorney, Agent, or Firm*—Oliff & Berridge, PLC

(57) ABSTRACT

A sheet handling system having a number of sheet processing modules (1–4) linked together to enable sleets to pass between them. Each sheet processing module (1–4) includes at least one sheet monitoring or handling component and a set of nodes (23, 32, 43, 62), each including a processor, wherein each sheet processing module is controlled by one or more nodes. A distributed control system is arranged logically into a number of subsystems, the functions of each subsystem being performed by one or more of the nodes. A communications network (24) links the nodes together to enable the nodes to operate in synchronism and to communicate with each other.

12 Claims, 5 Drawing Sheets

SHEET HANDLING SYSTEM

The invention relates to a sheet handling system, for example for handling documents of value such as banknotes.

Conventional banknote handling systems are purpose designed depending upon their field of use. For example, certain systems may be provided to operate on a single denomination of banknote and to sort such banknotes into those which are reusable, those which must be destroyed, and those which require manual inspection. Other systems are provided for sorting banknotes by denomination. The systems may simply stack the sorted banknotes or provide additional banding facilities and/or a shredding capacity. Operation of the system is controlled by a central controller which interfaces with the various components such as sensors and diverters to detect and categorise notes passing through the system and to control their destination.

The problem with existing systems is that they are relatively inflexible so that updating such systems to take account of improvements in software or hardware are time consuming and often require substantial redesign of the system.

In accordance with the present invention, a sheet handling system has a number of sheet processing modules linked together to enable sheets to pass between them, each sheet processing module including at least one sheet monitoring or handling component; a set of nodes, each including a processor, wherein each sheet processing module is controlled by one or more nodes; a distributed control system arranged logically into a number of subsystems, the functions of each subsystem being performed by one or more of the nodes; and a communications network linking the nodes together to enable the nodes to operate in synchronism and to communicate with each other.

We have developed a completely new approach to such sheet handling systems. Firstly, the system is arranged in the form of a number of physically discrete sheet processing modules and secondly the control system is arranged logically into a number of subsystems, the software for which is distributed (typically copied) across the nodes which control operation of the modules. In this way, individual modules can be replaced without the need to reconfigure the system while distributing the control system across the nodes leads to much more efficient control of the sheet handling system. The nodes can also be replaced with very little down time.

Typically, each module will be self-contained so that it can be built and tested independently of other modules. Thus, for example, a stacker module may contain a stacking component, a diverter for diverting sheets to the stacking component and a transport component for transporting sheets to the diverter. The module will have its own motor(s) for driving the transport, diverter and stacking components.

Typically, each node processor stores programmes which can be adapted on supply of suitable parameters to operate with one or more of a number of different sheet handling or monitoring components. In the preferred example, each node processor stores programmes which can be adapted on supply of suitable parameters to operate with any sheet handling or monitoring component. Clearly, the more commonality that exists between the nodes, the easier it is to manufacture and/or update the nodes while a single node construction can be used with a wide variety of sheet handling components. During the set up process, a node will be configured to operate with the particular component to which it is attached by supplying suitable control parameters from a central machine database. If, however, a sheet handling component is changed, the same node can easily be reconfigured by supplying different parameters so as to control the new sheet handling component. An example would be replacement of a sheet transport by a new transport which could be accelerated at a faster rate.

In a similar way each node will typically store software for performing all the subsystems of the control system. At set-up, the appropriate parts of this software will be activated in each node depending upon the function(s) it performs in the sheet handling system.

In order to coordinate operation of the system, in the preferred example, each subsystem operates in accordance with a common lifecycle, the control system further comprising a machine coordinator, typically residing on a node, for signalling steps in the lifecycles to other software components in the system. Each subsystem can then be operated in synchronism with the other subsystems by stepping in sequence through the respective lifecycles having stages such as set-up, process select, running up, running and running down.

Conveniently, the control system includes a sheet tracking subsystem. This enables the passage of sheets through the sheet handling system to be monitored allowing each node to respond as necessary upon arrival of a sheet at any of its connected components.

This is most conveniently achieved if the sheet tracking subsystem includes a sheet register for storing information about each sheet being processed by the sheet handling system. Such a sheet register could be maintained centrally but this would require a very fast response communications network. In practice, therefore, it is more convenient if a copy of the sheet register is stored in all nodes which implement the sheet tracking subsystem. In this way, each node and the software relating to the node's attached components have immediate access to the local copy of the sheet register.

Typically, the sheet register will store information to enable the nodes to determine the estimated time of arrival of each sheet at each component associated with the node. The estimated time of arrival may be explicitly stored or it could be determined on each occasion it is required from the information in the sheet register such as the time of entry of a sheet into the sheet handling system. To determine the estimated time of arrival, each node will maintain a record, supplied on start-up, of the location of the component(s) relative to the sheet handling system entry point.

Preferably, the sheet tracking subsystem is adapted to update the information in the sheet register to account for variations in the expected passage of sheets. In some cases, a sheet may not follow its expected passage through the sheet handling system. For example, the sheet may slip in the transport or it may be rerouted to an alternative destination, for example if it is found to be counterfeit or the like. In these situations, the estimated time of arrival will need to be changed.

The sheet register may also store information relating to the destination of the sheet. From this information, each node can determine whether or not a sheet will need to be handled by the or one of the components attached to the node. This will reduce processing time during running since only those components which expect to receive the sheet need to determine its estimated time of arrival.

Typically, the stored destination will be the final destination in the system although it would also be possible to store an intermediate destination which is then updated during passage of the sheet. This allows dynamic re-routing of sheets in the event of the destined stacker suffering a malfunction. Where the stored destination is the final destination, each node preferably stores for the or each of its components a table indicating whether, for each possible destination, the sheet will be handled or monitored by the component.

In order to determine the destination of sheets fed into the sheet handling system, the system may further comprise a sheet routing subsystem which responds to information detected about the incoming sheet to determine its destination. Typically, the sheet routing subsystem will be implemented on a single node although the sheet routing software will be found on all nodes allowing any of the nodes to carry out that function. The node will be determined during set-up.

An example of a sheet handling system according to the present invention will now be described with reference to the accompanying drawings, in which.

Figure 1:
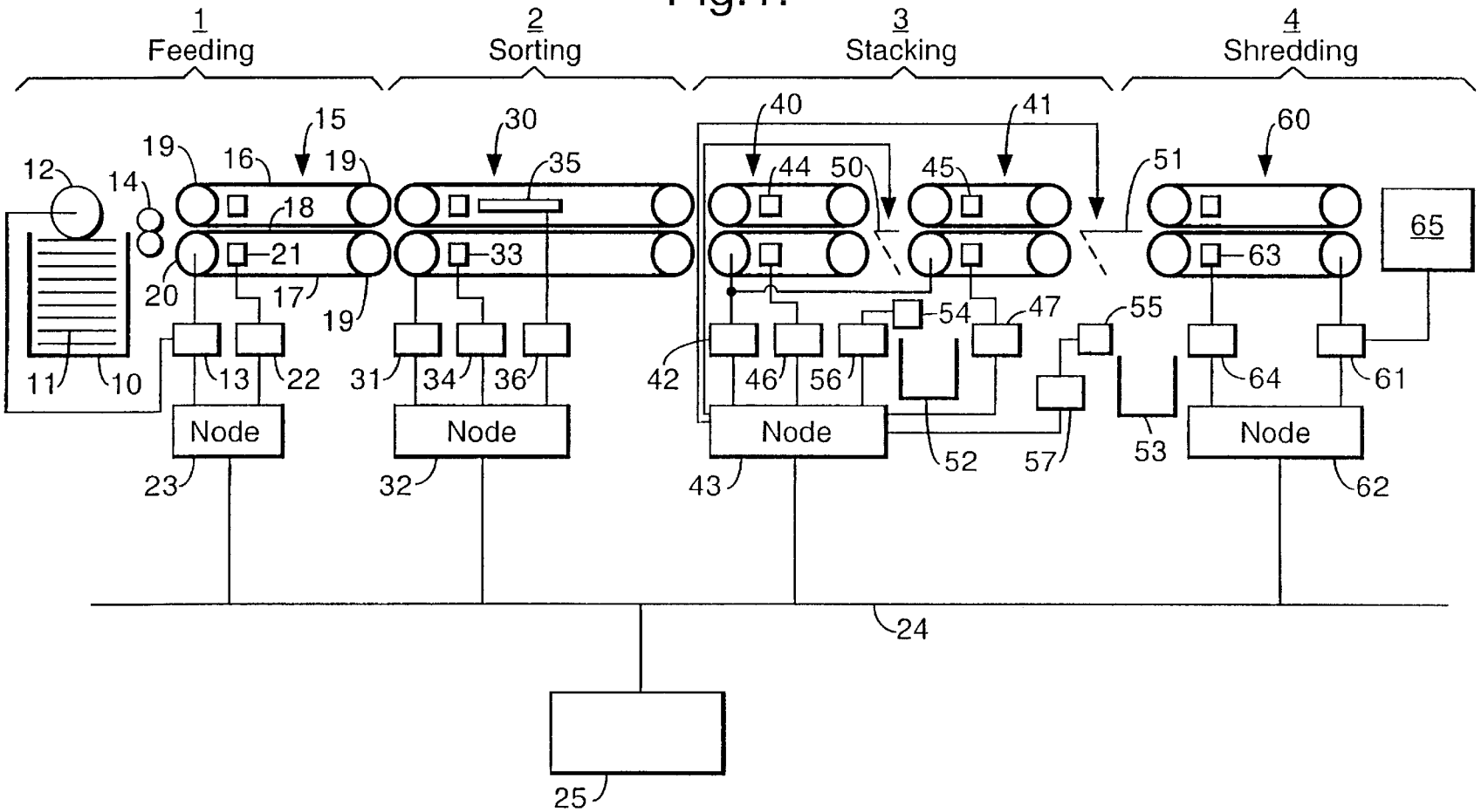
FIG. 1 is a schematic diagram of the system.

The sheet handling system to be described is for processing banknotes in which banknotes of a single denomination are sorted in accordance with their condition and authenticity. The apparatus is shown schematically in FIG. 1 and is made up of four modules 1–4 arranged in sequence. The module 1 is for feeding banknotes from a stack, the module 2 for detecting their condition and authenticity and determining the route they should follow, the module 3 is for stacking those banknotes which are to be stacked at one of two locations, and the module 4 is for shredding those banknotes which remain. It will be appreciated that this is a simplified structure chosen for the purposes of this description. In practice several other modules would also be used.

The module 1 includes a banknote hopper 10 in which a set of banknotes 11 to be sorted are stacked. The banknotes are fed out of the hopper 10 by a feed roller 12 rotated by a motor 13, the stack being urged towards the roller 12 by a pressure plate (not shown). Each banknote is fed through a conventional separator system 14 until it enters a transport system 15 comprising juxtaposed pairs of feed belts 16,17 defining a feed path 18. The belts 16,17 are entrained around idler rollers 19 while the belt 17 is also entrained around a drive roller 20 driven by the motor 13.

A new note sensor 21 is located adjacent the entrance to the transport 15, the sensor being connected to conditioning electronics 22.

The motor 13 and the conditioning electronics 22 are connected to a node 23 containing a microprocessor and other components to be described later. The node 23 controls operation of the motor 13 and determines information from the new note sensor 21. The node 23 then processes the information in a manner to be described below.

The node 23 is connected to a Controller Area Network (CAN) bus 24 of conventional form which enables it to communicate with the nodes of the other modules 2–4 and also a graphic control console 25.

The sorting module 2 comprises a transport system 30 similar to the transport system 15 and so this will not be described in further detail. As with the transport system 15, the transport system 30 is driven by a motor 31 under the control of a microprocessor within an associated node 32. An update sensor 33 senses the arrival of a note in the transport 30 and is connected to the node 32 via conditioning electronics 34.

The module 2 further includes an authentication detector 35 for establishing the authenticity/condition of the note being fed. The detector 35 can be of any conventional form such as a magnetic detector, luminescent detector or the like and generates signals, which are passed to the node 32 via an interface 36, from which the processor in the node 32 can determine the authenticity/condition of the note. The node 32 is connected to the bus 24.

The stacking module 3 comprises a pair of transport systems 40,41 positioned end to end and each being similar to the transport system 15. Both transport systems are driven by a motor 42 connected to a node 43 and each transport system is associated with a respective update sensor 44,45 connected via conditioning electronics 46,47 to the node 43.

A diverter 50 is positioned downstream of the transport 40 and upstream of the transport 41 while a diverter 51 is positioned downstream of the transport 41. In the positions shown in solid lines in FIG. 1, notes will be transported through the stacking module 3 to the shredding module 4. However, the diverters 50,51 can be individually activated to the position shown in dotted lines by suitable signals from the node 43 causing a note which is fed to the diverter to be diverted into a respective hopper 52,53.

Respective counting sensors 54,55 monitor the passage of notes into the hoppers 52,53 and provide signals which are passed to the node 43 via conditioning electronics 56,57 respectively.

In one example banknotes which can be recirculated are fed to the hopper 52 while banknotes of uncertain condition or counterfeit are fed to the hopper 53 for manual review. All remaining banknotes are assumed to be unusable and fed to the shredding module 4.

The shredding module 4 comprises a transport system 60 having a similar form to the transport system 15 and being driven by a motor 61 controlled by a node 62. A count sensor 63 is positioned at the entrance to the transport system 60 and is connected via conditioning electronics 64 to the node 62. A shredder 65 is positioned downstream of the transport system 60 and is driven by the motor 61.

The sensors 21,33,44,45 and 63 can be of any conventional form but will typically comprise optical sensors which detect the leading (and optionally trailing) edges of notes.

Figure 2:
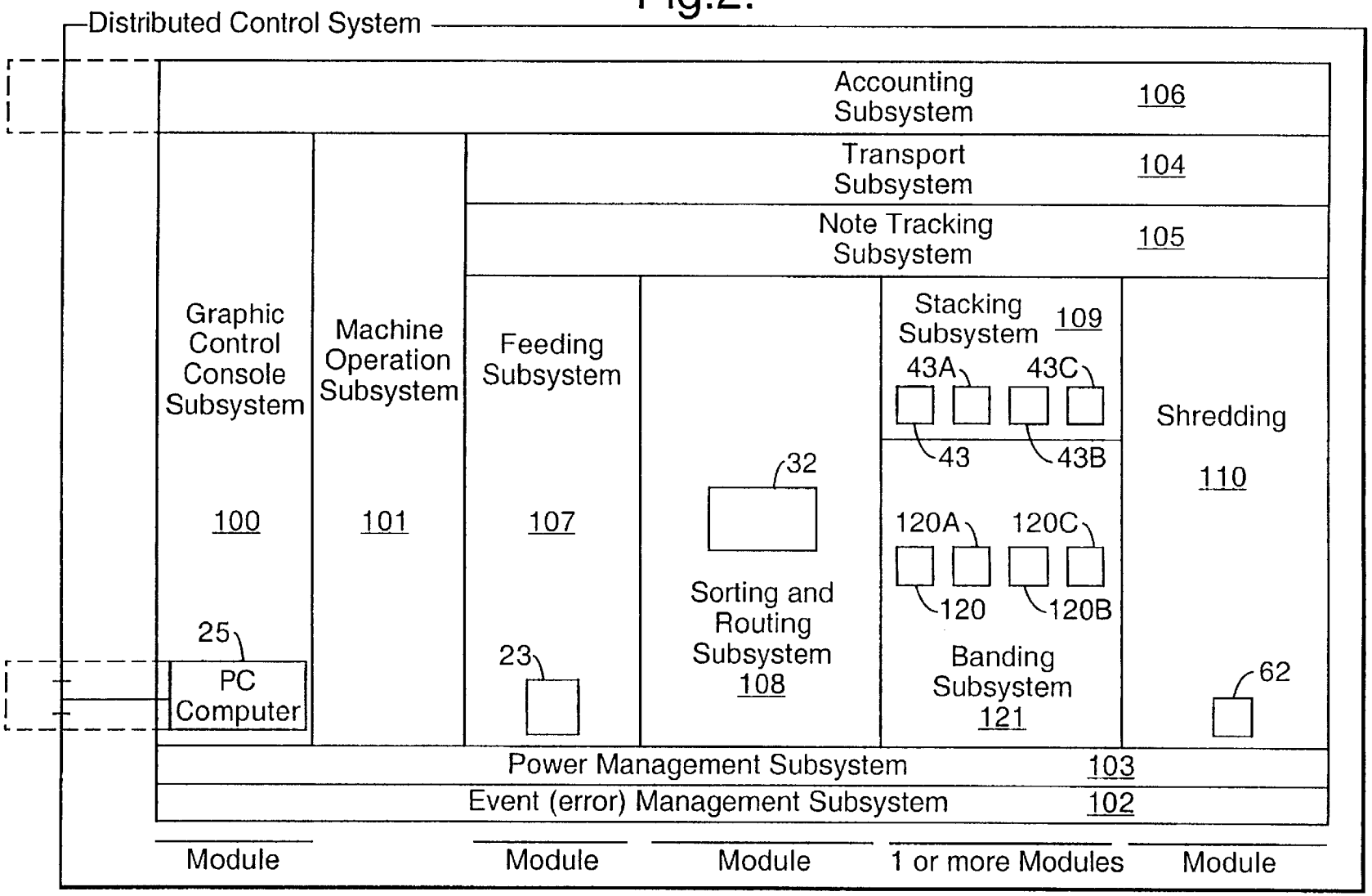
FIG. 2 illustrates the logical arrangement of the control software.

Control of the system shown in FIG. 1 is achieved primarily by software contained on the nodes 23,32,43,62 and the graphic control console 25. Furthermore, the software is logically arranged into a number of subsystems as shown in FIG. 2. These subsystems are as follows.

A graphic control console subsystem 100 provides a user interface. It allows the user to start and stop note feeding and provides the functionality required for reconciliation, reporting, diagnostics, configuration and external connectivity. A machine operation subsystem or machine coordinator 101 coordinates operation of the distributed subsystems and is linked to a database (not shown). An event (error) management system 102 is responsible for collecting all errors and warnings from the nodes and for investigating fault recovery procedures. It works in collaboration with the machine coordinator 101 to coordinate the machine wide actions necessary to respond to all fault conditions.

A power management subsystem 103 manages power supplies to all the modules.

A transport subsystem 104 controls operation of the various transports while a note tracking system 105 monitors the location of notes in the apparatus.

An accounting subsystem 106 monitors outputs from the count sensors 54,55,63 collates that information and uploads the collated information to the graphic control console subsystem 100.

More specific subsystems include a feeding subsystem 107 which is activated on the node 23 for controlling the feeding module 1, a sorting and routing subsystem 108 which is activated on the node 32 to control the module 2 and is responsible for detecting the type of note and determining its destination, a stacking subsystem 109 which is activated on the node 43 for controlling the stacking module 3, and a shredding subsystem 110 which is activated on the node 62 for controlling the shredding module 4.

Software capable of implementing any of these subsystems is provided on each node.

The configuration of this software across the nodes 23,32,43,62 and the graphics control console 25 is determined from parameters downloaded from the database and is shown in FIG. 2. Thus, software implementing the note tracking subsystem 105 and the transport subsystem 104 is enabled on each of the four nodes while the graphic control console subsystem 100 is enabled on the console 25.

The transport subsystem software 104 will be the same on each node since the same motor(s) are provided.

The note tracking subsystem software 105 will be selectively activated according to the node concerned and the type of sensor (new note, update or count) as described below. However, the selected parts cooperate together as the note tracking subsystem via the interchange of messages via the bus 24.

As shown in FIG. 2, in other applications, there may be more than one node equivalent to the node 43 allowing the use of more diverters and stackers while each stacker may be associated with a corresponding bander which would then have its own node 120 which would implement a banding subsystem 121.

The machine operation subsystem can be enabled on any node.

An important aspect of the present invention is the distribution of certain subsystems across the nodes. A typical example is the note tracking subsystem 105. Thus, the implementation of the note tracking subsystem 105 in the feeding module node 23 will be, using the new note sensor 21, to:

i) detect whether a note has been successfully fed into the machine, and ii) determine the exact timing of the launch of a note into the machine (time stamping), and to provide a unique identification of the note, the node then broadcasting this information to all other nodes over the bus 24.

In all other modules, the note tracking subsystem software responds to information from the respective connected sensors 33,44,63 and from upstream modules via the bus 24 to:

i) become aware of the absolute physical position of a note in relation to the sensor so that timing calculations can be made based on received information about the current transport speed, ii) receive prior notice of notes in the transport subsystem, iii) keep a list of all notes in progress through the machine and the time window within which each one is expected to arrive (to be described in more detail in connection with the note register), iv) check, when a note arrives, that it is within the correct timing tolerance. If it is then a message with its corrected timing and identity can be broadcast so all down the line elements of the subsystem can update their estimated time of arrivals and tolerance windows to minimise cumulative errors within the machine, v) if a note arrives too late, broadcast an event message to identify the late note so that other down the line elements of the subsystem know it is late or will never arrive, and vi) if a note arrives too early, determine that it is likely to be a false detection or possibly a piece of debris. Again, an event message will be sent to warn down the line elements of the subsystem and possibly elements of other subsystems.

Certain sensors, such as sensors 33,44,45, in the system act as "update" sensors which are placed at strategic points to monitor the passage of notes through the system. These carry out the functions set out above. Other sensors such as the sensors 54,55,63 act as "count" sensors and are provided at each note destination to check that the note has actually reached the destination and still appears to have the characteristics expected of it. Each count sensor checks the actual expected time of arrival of each note; and informs the accounting subsystem for each note expected at the sensor that it either has been counted or is missing.

Figure 3:
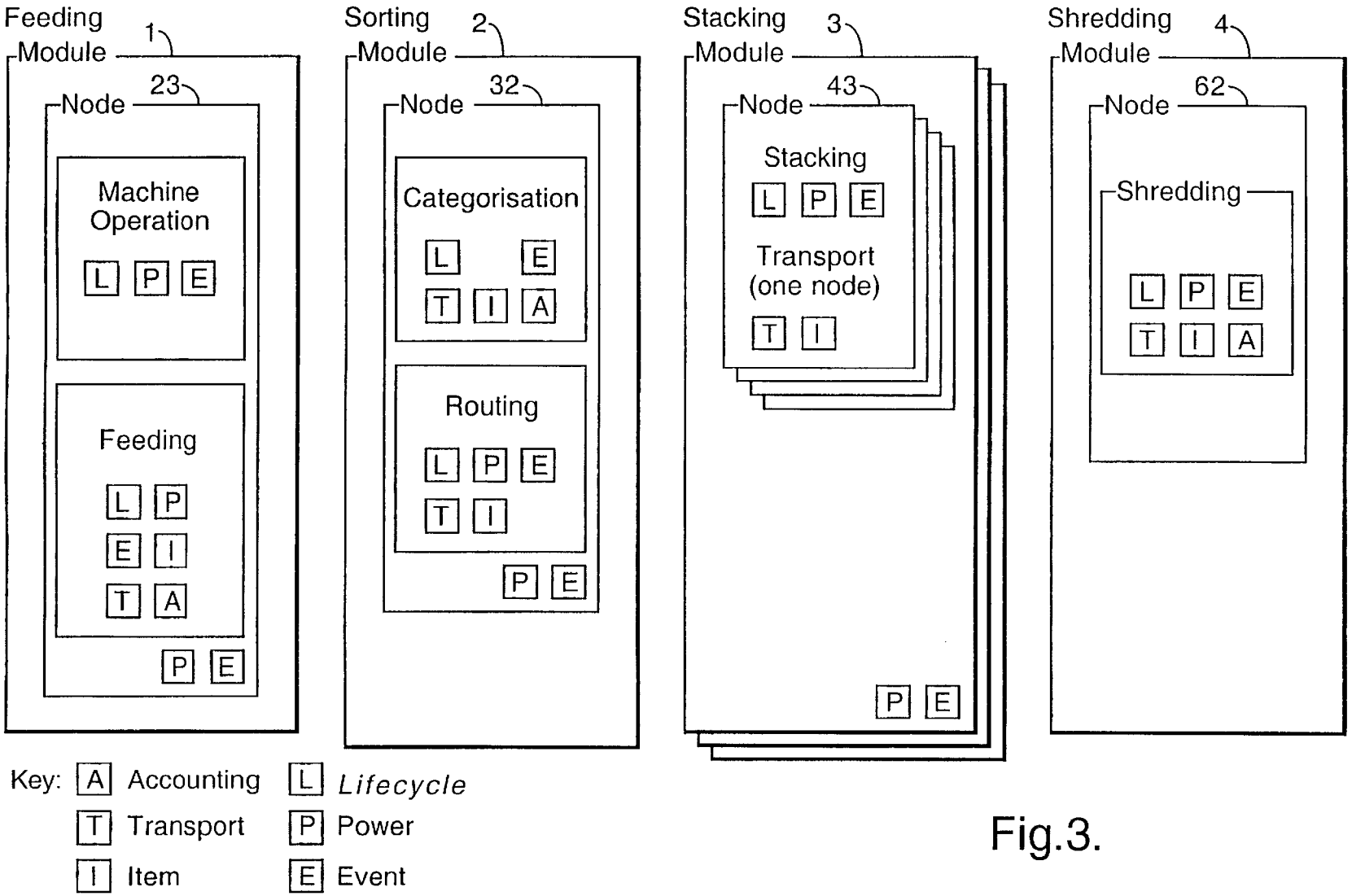
FIG. 3 illustrates the distribution of subsystems across modules.

FIG. 3 illustrates an example of the distribution of subsystems within the nodes and modules. The letters A, T, I, C, P, E indicate the subsystems enabled within each node.

Figure 4:
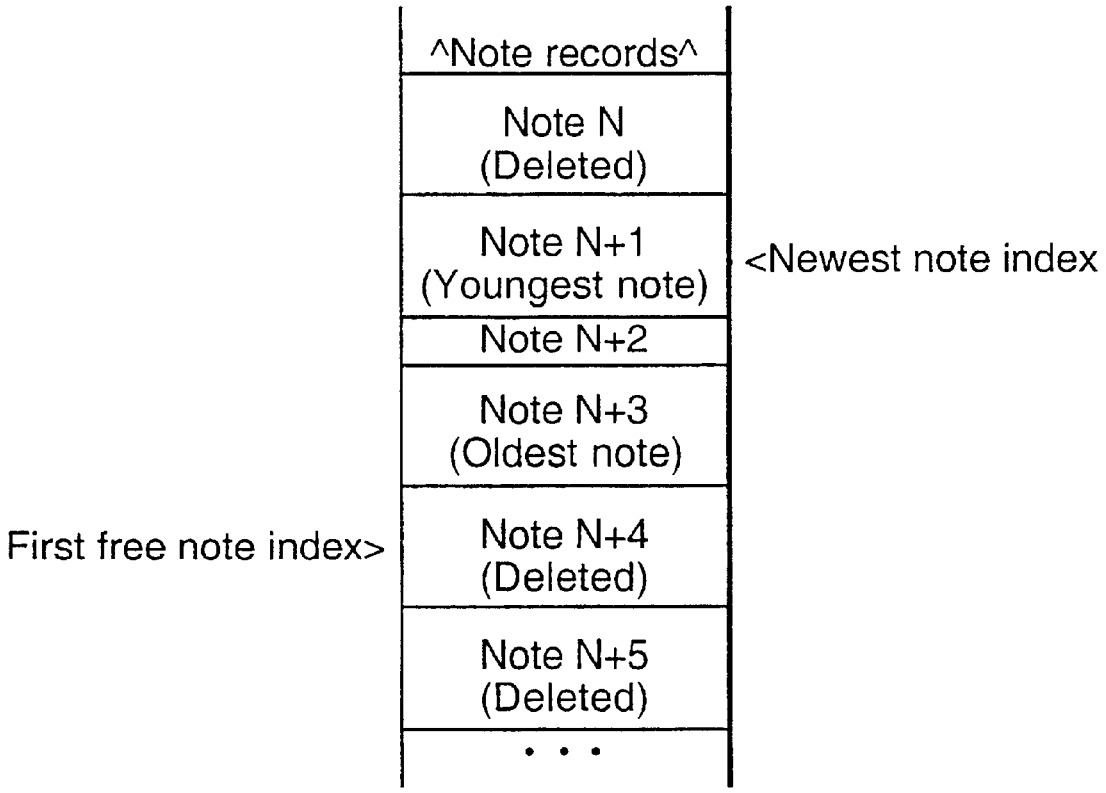
FIG. 4 illustrates an example of a set of note records.

As briefly mentioned above, each node which operates part of the note tracking subsystem 105 will maintain a copy of a note register. This note register contains certain details relating to notes which have entered the system and have not yet been fully processed. For each component (or "client/customer") associated with a node, such as a diverter, the node maintains two indices—"note data" and "dead note". Each index is in the form of an array of 255 addresses, one per note, indexed by the note ID, which is initially generated by the note tracking subsystem from the new note sensor 21. An example of a set of note records for a system currently handling three notes is shown in FIG. 4. The "newest note index" points to the note record for the most recently received new note message—the youngest note in the system—while the "first free note index" points to the note immediately after the oldest note in the system.

As mentioned above, two indices are maintained for each component attached to a node. The first, note data index, indicates the note record last given to a component and the dead note index indicates the youngest note that the component has finished with. As soon as a component has finished dealing with a note, the appropriate component subsystem will request the next note (an instruction on how to deal with the next note and when to carry out the instruction) from the note tracking subsystem.

In the running state, there are 7 note messages and 2 client messages that may be received and these are used to update the corresponding note registers at each node. The messages and hence the note register information are as follows.

New Note. Add the note to the register and send the note record to each client that is both on every note path and is waiting for a note record. When software components are enabled, they know whether they require note information or not. If they do then they must register as clients with their local note register.

Note Missing. Set the note record's status to missing. Move the First free note index up as far as possible. If any clients Note data or Dead note index points to the missing note, set that index to $NO_{13}$ NOTE.

Note Counted. As for note missing, but set the status to deleted. If any client's Note data index points to the counted note, send a note deleted message to the client.

Note Position Update. Correct the note record. If any client's Note data index points to the slipped note, send a note ETA update message to the client.

Note Length. Update the note record. If any client's Note data index points to the measured note, send a note length update message to the client.

Note Destination. Update the note record. For each client that the note will pass—If the client is waiting for note data, send it the routed note record. If the client is not waiting for note data, but the newly routed note will reach the client before the one it knows about, send it a re-routed note record.

Note Re-route. Update the note record. For each client where the note data index is the re-routed note, if the client is no longer on the note path, send a note re-routed from message. For each client on the note path where the note data index is not the re-routed note—If the client is waiting for note data (a "note required" flag is set), send it the re-routed note record. If the client is not waiting for note data, but the newly routed note will reach the client before the one it knows about, send it a re-routed note record.

Next Note Request. Look for a note after the dead note index and note data index, that is routed to pass the component. If one exists, send a new next note message to the client, otherwise, mark the client record as requiring a note.

Cancel Note Request. Set the client's note data index to $NO_{13}$ NOTE, and clear the note required flag.

Figure 5:
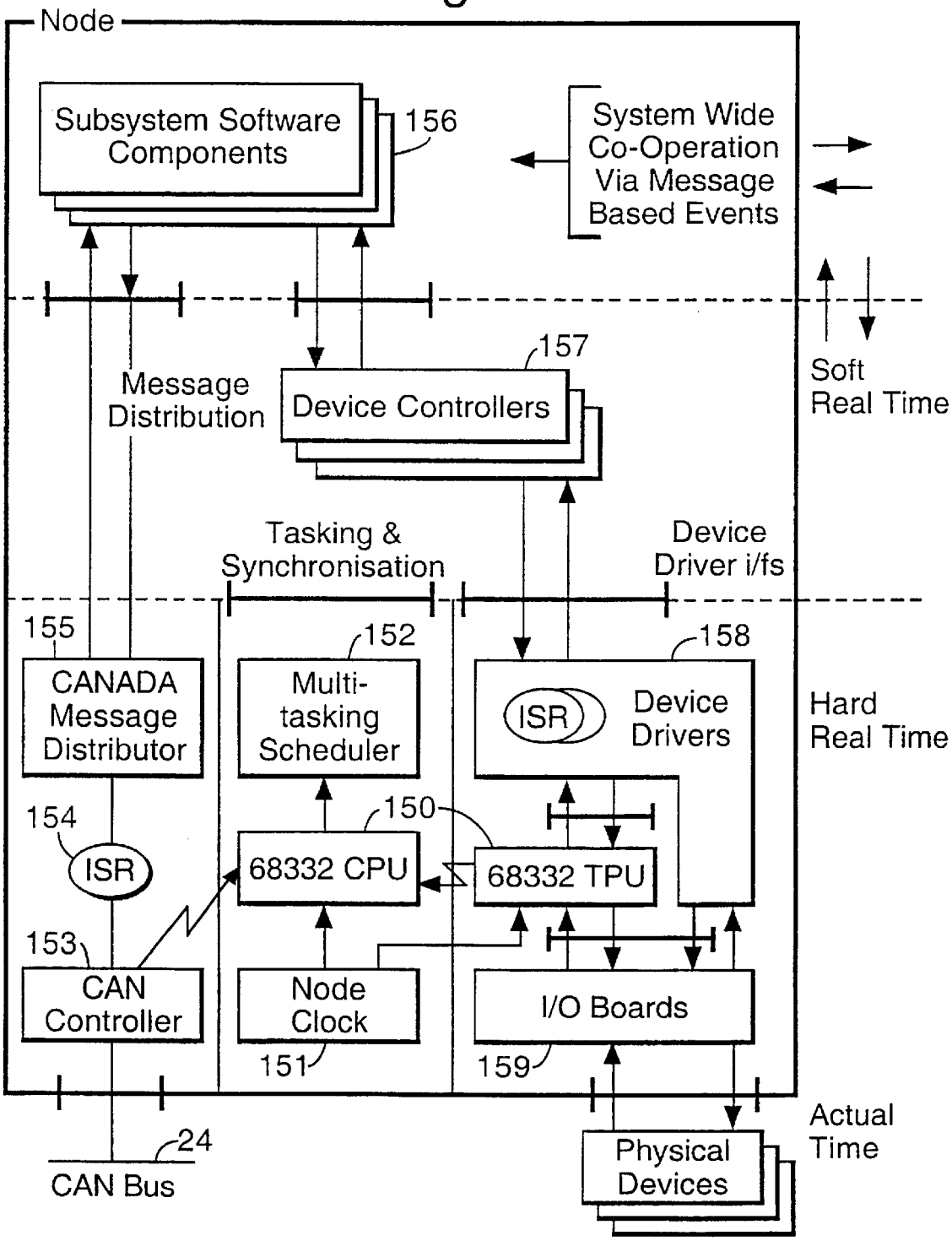
FIG. 5 is a block diagram of the hardware components of a typical node.

Each node has a similar construction and stores software allowing it to be used with any component. The basic node architecture is shown in FIG. 5 and comprises a microprocessor 150 (CPU and TPU) coupled to a node clock 151 and a multi-tasking scheduler 152. In operation, the clock 151 of one of the nodes is selected to be the master and the other node clocks act as slaves to that master so as to be synchronized with it. Communication with the CAN bus 24 is carried out via a controller 153 coupled via an Interrupt Service Routine (ISR) 154 with a message distributor 155. Software for those subsystems which are implemented by the node is stored at 156. Each physical device such as a motor, diverter or sensor is driven by respective device controllers 157 which communicate with device drivers 158 and, via I/O boards 159 with the devices themselves.

The subsystems operate in accordance with respective lifecycles, a changeover between lifecycles being controlled by the machine operation subsystem 101. On start-up, the initial set-up stage of each lifecycle is entered and various parameters are downloaded into the nodes 23,32,43,62 allowing operation of the software components needed for controlling the hardware components attached to the respective nodes. In addition, each node determines for each of its components the destinations which bring a note past that component, and the location of that component within the system relative to its start. This enables ETAs to be determined subsequently. Initially, these details are directly copied from the GCC database to the relevant components.

Following the set-up process, and after an initialization phase, each lifecycle switches to a "running" phase. In that phase, the transport subsystem 104 causes the transport systems 15,30,40,41 and 60 to run at their normal transport speeds and notes begin to be fed from the stack 11 into the transport system 15. As soon as the new note sensor 21 detects a note, this information is processed by the node 23 to allocate a note ID and to timestamp the note arrival time, this information then being communicated via the bus 24 to the other nodes using a New Note message so that each can set up its own note register for that note and an entry in its local note register.

On receipt of a New Note message, each node determines which of its components may receive the note and then calculates an ETA for that component which is stored.

The note then passes to the sorting module 2 where its arrival is sensed by the sensor 33. This sensor is an update sensor and the note tracking subsystem determines the time of arrival of the note and compares this with the previously determined ETA for that sensor. If there has been a change in the note position, for example due to slippage, then the note tracking subsystem on the node 32 generates a Note Position Update message containing corrected time information and the note ID which is then transmitted to the downstream nodes on the bus 24. These nodes then update their note registers as appropriate and if any one of the components attached to those nodes expects to receive the note then a note ETA update message is sent to the control software of the subsystem relating to that component enabling it to compute a new ETA.

The note then passes the sensor 35. The note sorting and routing subsystem 108 then operates on the information from the detector 35. This subsystem 108 includes a router component which is responsible for taking note category information from the detector 35 and assigning a physical destination to the note. The note routing subsystem 108 also includes diverter software components which are associated with diverters 50,51 and are thus provided in an active form on the node 43 for physically routing a note to its assigned destination. The destination information is sent to all downstream nodes for storage in their note registers using a Note Destination message.

The note passes to the stacking module 3 and is detected by the update sensor 44 which may generate a Note Position Update message as previously described in connection with the sensor 33. At regular intervals, the diverter software components on the node 43, forming part of the stacking subsystem 109, interrogate the note register for information about the next note and compute its time of arrival at the diverter. When it determines that the note has arrived, the diverter is set as required in accordance with the destination information. To that end, a Table is kept within the node 43 for each of the diverters 50,51 providing a concordance between the ultimate destination of a note as determined by the note routing subsystem and the condition of the diverter. Thus, for example, if the ultimate destination is the shredder 65, each diverter 50,51 will determine that it must maintain its undiverted state when the note arrives. If the ultimate destination is the hopper 53, then the diverter 50 must maintain its undiverted state while the diverter 51 must switch to its diverted state.

The note tracking subsystem 105 monitors the passage of the note as it arrives at each of the sensors 33,44,45,63 and this allows any slippage to be detected, this information then being communicated to the other nodes.

In this simple example, note re-routing has not occurred because there is only one condition sensor 35.

On completion of a note feeding operation, the next stage in the lifecycles is initiated and typically the system will power down.

What is claimed is:

1. A sheet handling system having a number of sheet processing modules linked together to enable sheets to pass between them, each sheet processing module including at least one sheet monitoring or handling component; a set of nodes, each including a processor, wherein each sheet processing module is controlled by one or more nodes; a distributed control system arranged logically into a number of subsystems, the functions of each subsystem being performed by one or more of the nodes; and a communications network linking the nodes together to enable the nodes to operate in synchronism and to communicate with each other, wherein the control system includes a sheet tracking subsystem, wherein the sheet tracking subsystem includes a sheet register for storing information about each sheet being processed by the sheet handling system, and wherein a copy of the sheet register is stored in all nodes which implement the sheet tracking subsystem.

2. A system according to claim 1, wherein each subsystem operates in accordance with a common lifecycle, the control system further comprising a central machine coordinator coupled to the nodes for signalling steps in the lifecycles to the nodes.

3. A system according to claim 1, wherein the sheet register stores information to enable the nodes to determine the estimated time of arrival of each sheet at each component associated with the node.

4. A system according to claim 3, wherein each node includes a store for storing the estimated time(s) of arrival.

5. A system according to claim 1, wherein the sheet register stores information relating to the destination of the sheet.

6. A system according to claim 5, wherein the stored destination is the final destination of the sheet in the system, each node storing for the or each of its components a table indicating whether, for each possible destination, the sheet will be handled or monitored by that component.

7. A system according to claim 1, wherein the sheet tracking subsystem is adapted to update the information in the sheet register to account for variations in the expected passage of sheets.

8. A system according to claim 1, wherein the control system includes a sheet routing subsystem for determining the destination of sheets fed into the sheet handling system.

9. A system according to claim 1, wherein each sheet handling component comprises one of a sensor, diverter, transport, stacker, bander, or counter.

10. A system according to claim 1, wherein each node has a local clock, the local clock of one of the nodes constituting a system clock to which the other local clocks are synchronized.

11. A system according to claim 1, wherein each node processor stores programmes which can be adapted on supply of suitable parameters to operate with a number of different sheet handing or monitoring components.

12. A system according to claim 11, wherein the parameters are supplied from a central machine database.

* * * * *